US007037441B2

(12) United States Patent
Offord

(10) Patent No.: US 7,037,441 B2
(45) Date of Patent: May 2, 2006

(54) DURABLE PRESS CELLULOSIC FIBROUS SUBSTRATES WITH IMPROVED PHYSICAL PROPERTIES

(75) Inventor: David A. Offord, Castro Valley, CA (US)

(73) Assignee: Nano-Tex, Inc., Emeryville, CA (US)

( * ) Notice: Subject to any disclaimer, the term of this patent is extended or adjusted under 35 U.S.C. 154(b) by 0 days.

(21) Appl. No.: 10/817,615

(22) Filed: Apr. 2, 2004

(65) Prior Publication Data

US 2004/0194224 A1 Oct. 7, 2004

Related U.S. Application Data

(63) Continuation of application No. PCT/US02/31052, filed on Sep. 30, 2002.

(60) Provisional application No. 60/326,837, filed on Oct. 2, 2001, provisional application No. 60/385,022, filed on May 31, 2002.

(51) Int. Cl.
*D06M 13/10* (2006.01)
*D06M 15/00* (2006.01)

(52) U.S. Cl. ..... 252/8.61; 252/8.62; 252/8.63

(58) Field of Classification Search ..... 252/8.61, 252/8.62, 8.63
See application file for complete search history.

(56) References Cited

U.S. PATENT DOCUMENTS 2,992,138 A 7/1961 Bacon
3,138,802 A 6/1964 Getchell
3,311,496 A 3/1967 van Loo, Jr.
3,402,933 A 9/1968 Reeves et al.
3,526,474 A 9/1970 Reeves et al.
3,606,992 A 9/1971 Aldrich
3,632,556 A 1/1972 Pittman et al.
3,634,019 A 1/1972 Beaumont et al.
3,656,885 A 4/1972 Gagliardi
3,807,952 A 4/1974 Lauchenauer
3,827,994 A 8/1974 Cicione et al.
3,877,872 A 4/1975 Vail et al.
3,933,755 A 1/1976 Michaud et al.
4,076,896 A 2/1978 Bunkowski
5,846,266 A * 12/1998 Rattee ..... 8/457
6,428,653 B1 * 8/2002 Denton et al. ..... 162/24
6,451,234 B1 * 9/2002 Cliver et al. ..... 264/78

FOREIGN PATENT DOCUMENTS

GB 968 534 9/1964

OTHER PUBLICATIONS

Translation of Russian Inventor's Certificate No. SU 1122763A (Nov. 17, 1984).*
Database WPI, Section Ch, Week 198523 (Derwent Publications Ltd., London), XP002264733 & SR 1 122 763 A (Cotton Ind. Res. Inst.), (Nov. 1984).

* cited by examiner

*Primary Examiner*—Anthony J. Green
(74) *Attorney, Agent, or Firm*—Morrison & Foerster LLP

(57) ABSTRACT

This invention is directed to a finishing method and composition for greatly increasing the tear strength and flex abrasion resistance of durable press cellulosic (including cotton) fabric, without sacrificing its durable press properties.

4 Claims, No Drawings

DURABLE PRESS CELLULOSIC FIBROUS SUBSTRATES WITH IMPROVED PHYSICAL PROPERTIES

This application is a continuation of International Appln No. PCT/US02/31052, filed on Sep. 30, 2002 and designating the United States, which claims the benefit of Provisional appln. Ser. No. 60/326,837, filed Oct. 2, 2001, and of Provisional appln. Ser. No. 60/385,022, filed May 31, 2002, all of the disclosures of which are incorporated herein by reference.

FIELD OF THE INVENTION

This invention is directed to a finishing method and composition for greatly increasing the tear strength and flex abrasion resistance of durable press cotton fabric, often greater than that of the untreated cotton fabric, without sacrificing its durable press properties.

BACKGROUND OF THE INVENTION

It is well known to impart durable wrinkle resistance to cellulosic fabric such as cotton fabric by impregnation with an aqueous solution of a suitable thermo-setting resin precondensate or a cellulose crosslinking agent, usually accompanied by an appropriate catalyst, and eventually curing the impregnated fabric. Such treatment has been effective in improving the wrinkle resistance and the shape-holding properties of cotton fabrics and has resulted in greatly increased demand for "Easy-Care", "Wash-And-Wear", "Permanent-Press", and "Durable-Press" cotton fabrics that are desired in today's textile market.

A variety of processes have been developed and used for improving wrinkle resistance or wrinkle recovery of fabrics and garments. These processes are known in general as pad-dry-cure chemical resin treatments, wherein one or more reagents are applied to the fabric through padding, and the fabrics are partially dried before the resin is cured.

The conventional thermo-setting chemical or resin systems (either post-cured or precured) result in embrittlement and reduction of mobility of the microstructural units of cellulosic fibers to such an extent that tearing strength, breaking strength and abrasion resistance are seriously impaired. Tearing strength is often reduced by 50%, breaking strength by 50–60%, and abrasion resistance by 75–85%.

Over the last several years, considerable research has been conducted to find ways of overcoming this problem without compromising the wash-wear or durable-press performance of the fabric. Many variations of pad-dry-cure processing have been developed in attempts to solve the problem. These include processes involving a multistage padding and curing, processes involving a pad and wet-fixation prior to cure, and processes involving polymeric additives. The results achieved through all of these processes have been marginal, and the processes have often been found to be cumbersome and expensive.

A particularly promising approach to the production of easy-care, durable-press fabric has involved a wet fixation of resin-forming, crease-proofing agents such as formaldehyde-melamine precondensate, as disclosed in *Textile Research Journal* 37, 70 (1967) and in U.S. Pat. No. 3,138,802. In this type of process, the fiber system, such as cotton fabric, is protected against an excess strength loss by fixation of a suitable resin-forming and crease-proofing agent within the fibers while they are wet and swollen. In the laboratory process the fabric, padded with a solution of reagents at pH=2 is heated in a moist atmosphere to achieve fixation of the N-methylol reagents. Part of the resin in contact with the cotton is firmly fixed in the cotton fibers and the fabric at this stage; after rinsing and introduction of a catalyst and softener, the fabric can be cured immediately or stored prior to cure at elevated temperature. However, wet fixation processes have generally been cumbersome, or have required special processing equipment.

The use of nonreactive or co-reactive additives for the purposes of obtaining improved abrasion resistance on durable-press fabrics is discussed in *Textile Research Journal* 37, 253 (1967). This type of approach is exemplified in U.S. Pat. No. 3,877,872, which calls for the inclusion of triethylene glycol dimethyl ether in a conventional reagent bath consisting of methylolated methylolmelamine and a cross-linking agent, such as dimethyloldihydroxyethyleneurea and a catalyst, such as zinc nitrate or magnesium chloride. This same patent also illustrates the introduction of an aqueous emulsion of polyurethanes into fabric in a separate step to develop a fiber coating that enhances abrasion resistance. In general, the benefits are less than desired from such modifications of conventional cross-linking treatments.

In U.S. Pat. No. 3,606,992 there is described a method for treating cotton-containing fabric for obtaining improved wrinkle resistance and improved abrasion resistance which involves padding the fabric through a resin finishing bath containing a mixture of a conventional thermo-setting resin in combination with a latex emulsion prior to a subsequent drying step, and a final curing at elevated temperature. In this case the additive is a synthetic rubber latex, which consists of a carboxy-modified butadiene-styrene copolymer in emulsion form. This preformed polymer undergoes some reaction with the resin-forming reagents to produce a coating on fabric, yarn and fiber surfaces.

U.S. Pat. No. 3,311,496 describes a process that involves pretreatment of fabric with hardenable aminoplasts by the wet steam process before treatment with crease-proofing hardenable aminoplasts. At a given level of wrinkle recovery, the tensile strength of the product is significantly higher than that of the unpretreated fabric. U.S. Pat. No. 2,992,138 teaches to overcome adverse effects upon tensile strength of fabrics caused by zinc nitrate catalyst employed with dimethylolethyleneurea by introducing an alkali metal acetate into the reagent mixture. U.S. Pat. No. 3,402,988 achieves improved abrasion resistance and other properties by first impregnating fabric with conventional wash-wear formulations, and second applying a catalyst deactivator on the top and bottom of the fabric, so that superior properties are retained in the surface area. According to U.S. Pat. No. 3,634,019, high strength losses in cellulosic fabrics when treated with crease proofing agents to produce durable-press properties are avoided by eliminating a major part of the usual acidic catalyst and adding an amount of zinc or aluminium acetate.

In U.S. Pat. No. 3,807,952 there is described, a method for improving abrasion resistance in crosslinked cellulosic fibers which amounts to introducing salt additives to the conventional reagent system. U.S. Pat. No. 3,827,994 refers to imparting abrasion resistance and permanent press properties to cellulosic materials by employing N-methylollactamide in conjunction with other N-methylol reagents. U.S. Pat. No. 3,526,474 describes a process for imparting abrasion resistance and wrinkle resistance and durable-press properties to cellulosic fibers by first applying the N-methylol reagent and subjecting it to curing conditions in the presence of a so-called polymerization catalyst and later impregnating the treated fabric with latent acid catalyst, drying and finally curing. U.S. Pat. No. 3,656,885 achieves improvement in wear resistance of cotton fabrics in wash-wear or durable-press garments by sequentially separate steps of swelling, substitution, and crosslinking of fabric and, more specifically applying to cotton pairs of mono-functional and polyfunctional reactive swelling agents.

SUMMARY OF THE INVENTION

The present invention is directed to a process for simultaneously achieving resilience (as evident in durable press appearance rating, wrinkle resistance and easy-care properties) and strength or endurability (as evident in abrasion resistance and tearing strength) of fabric and other fibrous substrates.

We have fortuitously found a finishing method for increasing the tear strength and flex abrasion resistance of durable press cellulosic fibrous substrates, including cotton fabric, without sacrificing its durable press properties.

The method involves combining formamidine sulfinic acid ("FSA") with a durable press agent and a catalyst (said agent and catalyst may be present in the form of a (preferably aqueous) durable press formulation), and an additional component selected from the group consisting of a polyethylene softener, one or more water- and oil-repellent agents, and combinations thereof, to give the finish composition of the invention. Fibrous substrates are exposed to the resulting finish composition by methods known in the textile arts.

This invention is further directed to the cellulosic fibers; yarns; woven, knitted or nonwoven fabrics and textiles; and finished goods (all encompassed herein under the term "fibrous substrates") treated with the finish composition of the invention, the treated fibrous substrates exhibit an improved resilience and endurability. By "improved resilience and endurability" is meant that the treated fibrous substrate will have increased tear strength and flex abrasion resistance over that of a substrate treated with a durable press agent alone.

DETAILED DESCRIPTION OF THE INVENTION

Unless otherwise indicated, "a" and "an" as used herein and in the appended claims shall mean "one or more".

The formamidine sulfinic acid was originally added by the inventor to cellulosic fibrous substrates, including those to be treated with a durable press agent, as a whitening agent (a dye-stripping agent commonly used in the textile industry). However, unexpectedly and surprisingly, a dramatic increase in tear and abrasion resistance of the fabrics treated with FSA was observed. Other reducing agents were tried, but they had no effect. Formamidine sulfinic acid by itself was tried, with no benefit observed. The mechanism of FSA improvement of physical properties is unknown.

Formamidine sulfinic acid, which is also known as aminoiminomethane-sulfinic acid or thiourea dioxide, is sold on the market industrially and is available as a white powder superior in preservative stability and having neither oxidizing property nor reducing property. Formamidine sulfinic acid displays reducing properties when an aqueous solution thereof is made alkaline or heated, and its reducing power is very large. Additionally, as compared with conventional reducing agents, e.g. sodium hydrosulfite, formamidine sulfinic acid as a powder or an aqueous solution is superior in stability and scarcely produces an objectionable smell.

Such characteristic features of formamidine sulfinic acid allow this substance to be used in various fields, including its application to the textile industry, for example as a reducing agent for vat dyes; a reduction clearing agent for fibers dyed with disperse dyes; a decoloring agent for fibers dyed with various dyes; a tank detergent for dyeing machines; a shrink-proofing agent for keratin fibers; a bleaching agent for protein fibers, polyamide fibers and phenolic resin fibers; a decolorizing agent to be used in the manufacturing process for polyacrylonitrile fibers and polyvinyl alcohol fibers; a white discharge printing agent for various dyes; a colored discharge printing agent; and a color fastness improver; and also its application as a pulp bleaching agent, an antioxidant for organic amines, a polymerization catalyst, a photographic sensitizing aid, an ingredient of cleaning materials, a reducing agent for metal ions, and reducing agents of organic compounds, for example as nitro compounds to hydrazo compounds or amines, ketones to secondary alcohols, aldehydes to primary alcohols, and disulfides to thiols. It has not been known, prior to the present invention, as an agent for imparting durable press or tear and abrasion resistance to fabrics.

The present invention is useful for treating various cellulose-containing or cellulosic fibrous substrates. The "cellulose-containing" or "cellulosic" fibrous substrates to be treated according to the present invention include any natural or artificial cellulosic fibers alone or as mixtures with each other in various proportions or as mixtures with other fibers, whether as a majority or a minority component. They include natural cellulosic fibers such as paper, cotton, linen, jute, ramie, industrial hemp, and the like, and in addition, the regenerated artificial cellulosic fibers such as the various types of rayons. Other fibers may be used in blends with one or more of the above-mentioned cellulosic fibers; these supplementary blend fibers may be, but are not limited to, wool, silk, cellulose acetate, polyamides, polyesters, acrylics, polyurethanes, and vinyl-based fibers. The preferred percentages of cellulosic fibers are upward from about 25%. In a presently preferred embodiment, the cellulose-containing fiber or fibrous substrate is cotton.

The fibrous substrate may be knit, woven, nonwoven, or otherwise constructed fabric, or the invention may be applied to fibers or yarns before they are converted into the complex structures. Thus, this invention is further directed to the fibers, yarns, fabrics, textiles, or finished goods (encompassed herein under the terms "fibrous substrates" and "substrates") treated with the combination of the present invention. Such substrates exhibit an improved resilience and endurability. By "improved resilience and endurability" is meant that a cellulosic fibrous substrate treated with a durable press formulation plus FSA and polyethylene (or, alternatively, a water- and oil-repellent agent) according to the present invention will exhibit increased tear strength and flex abrasion resistance without sacrificing its durable press properties, even after multiple washings, in comparison to the untreated substrate or the substrate treated with the durable press formulation alone. The terms "durable" and "durability" as used herein describe a finished fibrous substrate in which the desired properties imparted to the substrate by the finish are observed after multiple launderings or dry cleanings, up to at least ten home launderings for example.

The finish composition of the present invention comprises formamidine sulfinic acid ("FSA") and a durable press formulation comprising a durable press agent and a catalyst, in an appropriate solvent. The preferred solvent is water. A polyethylene softener and/or a water- and oil-repellent agent must also be added to the finish composition of the invention. Optionally, other additives such as wetting agents and the like, may also be included. The amounts of the various ingredients in the finish composition will be dependent upon the particular chemical makeup of the ingredient, the physical characteristic(s) to be achieved, the composition of the fibrous substrate, and the like. The particular amounts and proportions can be determined without undue experimentation by those skilled in the art. Generally, the composition of the invention comprises from about 0.005% to about 60%, preferably from about 0.01% to about 10%, more preferably from about 0.1 % to about 5%, and most preferably from about 0.25% to about 2% of FSA.

In one embodiment, formamidine sulfinic acid and a polyethylene softener are suspended in a solvent, preferably an aqueous solution, together with a durable press agent and a catalyst. A water- and oil-repellent agent, such as an emulsified paraffin wax and/or a fluorochemical finish, may also optionally be included, or it may be substituted for the polyethylene softener. The paraffin wax and the fluorochemical finish, which are primarily used to impart oil and water repellency characteristics to the fibrous substrate, also may increase the flex abrasion and tear properties of the cellulosic substrate slightly on their own, but when combined with FSA, these properties are greatly enhanced. The fibrous substrate to be treated is then exposed to the resulting finish composition solution by methods known in the art such as by soaking, spraying, dipping, fluid-flow, padding, and the like. The treated fibrous substrate is then removed from the solution, dried and cured.

The durable press agent for use in the present invention may be selected from any of such agents as are presently known or that become known in the textile art for imparting wrinkle resistance to cellulosic fibrous substrates, with the proviso that it is compatible with the FSA and the other ingredients of the finish composition. Such compatibility can be determined without undue experimentation by those skilled in the art. Any compound capable of forming a crosslink between two hydroxyl groups may be used as the durable press resin component for treatment of cellulosic substrates. Examples of durable press agents include, but are not limited to, crosslinking resins such as glyoxals, melamines, isocyanates, epoxides, divinylsulfones, aldehydes, chlorohydrins, and N-methylol compounds, which compounds are known to those of skill in the art. Of these, N-methylol compounds have been used the most. Examples include dimethylol urea, dimethylol ethylene urea, trimethylol trazine, dimethylol methyl carbamate, uron, triazone, and dimethyloldihydroxyethyleneurea (DMDHEU).

The catalyst may be chosen from any appropriate catalyst for use with the durable press agent, with the proviso that it is also compatible with the FSA and the other ingredients of the finish composition. Examples of such catalysts are known in the art and include, but are not limited to, zinc nitrate and magnesium chloride. In a presently preferred embodiment, the catalyst is used in an excess of that amount necessary to catalyze the resin.

While the resins improve wrinkle recovery, fabric smoothness, and general appearance of cellulosic substrates, crosslinking has its disadvantages, including loss in tear and tensile strength and loss in abrasion resistance. Such durable-press fabrics also often have stiff, harsh, uncomfortable fabric tactile (hand) properties. Therefore, fabric softeners are commonly added to these fabrics to mitigate some of these deficiencies. Softeners improve the hand of the fabric. Surprisingly, it has been found that use of cationic or nonionic polyethylene softeners, and preferably high-density polyethylenes, work particularly well with the FSA to give the increased abrasion resistance and tear strength physical characteristics of the present invention.

The finish composition of the invention may further comprise a water- and oil-repellent agent. Such agents include, but are not limited to, emulsified paraffin waxes and fluorochemical textile finishes. The fluorochemical textile finish generally comprises, in a suitable solvent, a fluoropolymer, either alone or, optionally, with other components such as an extender, a wetting agent, a surfactant, an antioxidant, an anti-microbial, a softener, and/or other additives. Fluorochemical finishes are commercially available. The solvent is preferably water.

By "fluorinated polymer" or "fluoropolymer" is meant that the polymer will contain some perfluorinated or partially fluorinated alkyl chains to impart water and oil repellency to coated objects. Examples of commercially available proprietary fluoropolymers include, but are not limited to, Nuva® DCP and Nuva® HCP (Clariant AG, Basel, Switzerland); Freepel® FX-1202 and Freepel® 1225 (BFGoodrich Specialty Chemicals, Charlotte, N.C.); Zonyl® 8787 and Zonyl® 8300 (Ciba Specialty Chemicals Chemicals, High Point, N.C.); Repearl® F-4210, Repearl® F-8040, and Repearl® F-35 (Mitsubishi International Corporation, NY, N.Y.); and Unidyne® TG-470, Unidyne® TG-571, Unidyne® TG-590, Unidyne® TG-591, and Unidyne® TG-991 (Daikin America, Inc., Orangeburg, N.Y.). In a presently preferred embodiment of the invention, the fluoropolymer is the commercially available proprietary fluoropolymer, Nuva® DCP (Clariant AG, Basel, Switzerland). The fluorochemical finish is preferably NT-X100, a commercially available proprietary composition from Nano-Tex, LLC (Emeryville, Calif.).

In preparing the treated fibrous substrates of the invention, the process temperature can vary widely. However, the temperature should not be so high as to decompose the reactants or damage the substrate, or so low as to cause inhibition of the reaction or freezing of the solvent. Unless specified to the contrary, the processes described herein take place at atmospheric pressure over a temperature range from about 5° C. to about 180° C., more preferably from about 10° C. to about 100° C., and most preferably at "room" or "ambient" temperature ("RT"), e.g. about 20° C. The time required for the processes herein will depend to a large extent on the temperature being used and the relative reactivities of the starting materials. Therefore, the time of exposure of the substrate to the components in solution can vary greatly, for example from about one second to about two days. Normally, the exposure time will be from about 1 to 30 seconds. Following exposure, the treated substrate is dried at ambient temperature or at a temperature above ambient, up to about 200° C. The pH of the solution will be dependent on the substrate being treated. For example, the pH should be kept at neutral to slightly acidic when treating cotton with FSA and durable press resins, because resins will not react at basic pHs and cotton will degrade in strong acid. Unless otherwise specified, the process times and conditions are intended to be approximate.

The following examples are intended for illustrative purposes only and are in no way intended to be limiting.

EXAMPLES

Example 1

The following textile testing methods were employed:

Durable-press appearance rating ("smoothness") after three home launderings and tumble-drying cycle by AATCC test method 124-1996.

Tensile strength method according to ASTM test method D 5304-95 after one home laundering and tumble dry.

Tearing strength ("Elmendorf tear") by ASTM test method D 1424-96 after one home laundering and tumble dry.

Stoll flex abrasion resistance ("flex abrasion") by ASTM test method D 3885-92 after one home laundering and tumble dry.

Water repellency by water spray test method AATCC 22-1996.

Oil repellency by AATCC test method 118-1997.

Wrinkle recovery angle was determined by AATCC test method 66-1998.

The following materials were used:

Fabric: Harbor Twill (olive) cotton, Style #535611, 7.30 oz.yd$^2$ (Galey and Lord, Society Hill, S.C.).

Formamidine sulfinic acid (FSA) (Aldrich, Milwaukee, Wis.).

Sedgerez PCR-2: precatalyzed alkylated DMDHEU resin (Omnova Solutions Inc., Greensboro, N.C.), durable press agent.

NT-X100: fluorochemical finish for water and oil repellency (Nano-Tex, Emeryville, Calif.)

Phobotex JVA: emulsion of paraffin wax and melamine resin (Ciba Specialty Chemicals Corporation).

The following procedure was followed:

600 Grams of each sample treatment composition were made using distilled water for dilution. Components were weighed out in grams to one decimal place. pH was adjusted to 4.00 with 0.1M NaOH. Cotton samples were dipped in these solutions and padded to 70% wet pickup. All samples were dried for four minutes in a Despatch oven at 250° F., then cured in a Mathis LabDryer for one min. at 380° F.

TABLE I

| | Samples | | | |
|---|---|---|---|---|
| Sample | % PCR-2 | % FSA | % JVA | % NT-X100 |
| A | 0 | 0 | 0 | 0 |
| B | 9 | 0 | 0 | 0 |
| C | 9 | 0.75 | 0 | 0 |
| D | 9 | 0 | 6 | 0 |
| E | 9 | 0.75 | 6 | 0 |
| F | 9 | 0 | 0 | 4 |

TABLE I-continued

| | Samples | | | |
|---|---|---|---|---|
| Sample | % PCR-2 | % FSA | % JVA | % NT-X100 |
| G | 9 | 0.75 | 0 | 4 |
| H | 9 | 0 | 6 | 4 |
| I | 9 | 0.75 | 6 | 4 |

TABLE II

| | Physical properties | | | |
|---|---|---|---|---|
| Sample | Smoothness (DP Rating) | Tear (warp + fill, N) | Tensile (warp + fill, N) | Flex Abrasion (warp + fill, flex cycles) |
| A | 1.2 | 26 | 636 | 214 |
| B | 3.3 | 14 | 363 | 208 |
| C | 2.5 | 18 | 487 | 183 |
| D | 3.8 | 29 | 282 | 442 |
| E | 3.2 | 42 | 391 | 1383 |
| F | 3.8 | 20 | 347 | 330 |
| G | 2.7 | 32 | 415 | 1165 |
| H | 3.8 | 29 | 316 | 468 |
| I | 3.2 | 44 | 408 | 1774 |

All increases in physicals were durable to at least 10 home launderings.

Example 2

Following the procedures of Example 1, samples of cotton twill fabric (khaki, style 5356; Galey and Lord) were treated with various formulations (Table III) and tested. Table III shows the effects of additional durable press resin catalyst (magnesium chloride) to durable press formulations with FSA.

The results of Table III show that excess resin catalyst is desirable in the presence of FSA. Smoothness and wrinkle recovery angle (WRA) are decreased when FSA is added without catalyst ($MgCl_2$). Addition of catalyst ($MgCl_2$) shows improved WRA, improved smoothness and improved strength from the FSA.

TABLE III

Effect of additional resin catalyst on smoothness and physical properties.

| | | Formula # | | | | |
|---|---|---|---|---|---|---|
| | | 1 | 2 | 3 | 4 | 5 |
| Formula Component % | NRW | 0.25 | 0.25 | 0.25 | 0.25 | 0.25 |
| | PCR-2 | 9 | 9 | 9 | 15 | 15 |
| | JVA | 6 | 6 | 6 | 6 | 6 |
| | X100 | 4 | 4 | 4 | 4 | 4 |
| | NPE 40 | 3 | 3 | 3 | 3 | 3 |
| | NT-F100 | 0 | 1 | 1 | 1 | 1 |
| | Catalyst KR | 0 | 0 | 1.8 | 0 | 3 |
| Solution pH | | 3.63 | 3.64 | 3.62 | 3.64 | 3.61 |
| Fabric WPU % | | 69 | 63 | 63 | 63 | 66 |
| 0 HL | Spray Rating | 100 | 100 | 100 | 100 | 100 |
| | Oil Rating | 6 | 6 | 6 | 6 | 6 |
| 5 HL | Spray Rating | 100 | 90+ | 100 | 90+ | 100 |
| | Oil Rating | 6 | 5 | 6 | 6 | 6 |

TABLE III-continued

Effect of additional resin catalyst on smoothness and physical properties.

| | | Formula # | | | | |
|---|---|---|---|---|---|---|
| | | 1 | 2 | 3 | 4 | 5 |
| 10 HL | Spray Rating | 90+ | 90 | 80+ | 80 | 80 |
| | Oil Rating | 6 | 5 | 6 | 5 | 6 |
| 15 HL | Spray Rating | 90 | 90 | 80+ | 80 | 80 |
| | Oil Rating | 6 | 5 | 6 | 5 | 6 |
| 20 HL | Spray Rating | 80 | 80 | 80 | 80 | 80 |
| | Oil Rating | 5 | 5 | 5 | 5 | 5 |
| Elmendorf Tear Strength | Warp | 2.6 | 3.7 | 3.0 | 3.2 | 2.6 |
| (lbs), 0 HL | Fill | 2.5 | 4.0 | 2.9 | 3.2 | 2.2 |
| Tensile Strength | Warp | 86.0 | 99.5 | 88.3 | 104.0 | 84.0 |
| (lbs), 0 HL | Fill | — | — | — | — | — |
| Wrinkle Recovery Angle (degrees, warp + fill) | | 210 | 172 | 218 | 217 | 238 |
| Smoothness Rating | After 3 HL | 3.5 | 3 | 3.5 | 4 | 4 |

NRW = WetAid NRW (BF Goodrich), wetting agent
PCR-2 = Sedgerez PCR-2
JVA = Phobotex JVA
X100 = NT-X100
NPE40 = Ultrasoft NPE-40 (MFG Chemical, Dalton, GA), softener
Catalyst KR (Omnova Solutions Inc., Greensboro, NC), $MgCl_2$ resin catalyst
NT-F100 = 50% formamidine sulfinic acid

Example 3

Following the procedures of Example 1, samples (16×11 in) of 100% cotton twill fabric (khaki, style 5356; Galey and Lord) were treated with aqueous solutions of various formulations (Table IV). Samples were dried and cured in one step in a Mathis LabDryer, 1.5 minutes (total) at 375° F., and were tested. Table IV shows the results of tests for various textile physical properties after three home launderings.

TABLE IV

| | | Formula # | | |
|---|---|---|---|---|
| | | I | II | III |
| Formula Component % | NRW | 0 | 0.25 | 0.25 |
| | NFR | 0 | 15 | 15 |
| | NPE 40 | 0 | 4 | 4 |
| | FSA | 0 | 0 | 1 |
| | MG-2 | 0 | 3 | 3 |
| Solution pH, adjusted | | 4.0 | 4.0 | 4.0 |
| Fabric WPU % | | — | 61.7 | 61.8 |
| Flex Abrasion (avg., warp + fill) | | 490 | 3225 | 4681 |
| Elmendorf Tear Strength (avg. tear force, warp + fill) | | 29 | 47 | 51 |
| Tensile Strength (avg, warp + fill) | | 1016 | 656 | 677 |
| Wrinkle Recovery Angle (degrees, warp + fill) | | 149 | 183 | 187 |
| Smoothness Rating | | 1.3 | 3.6 | 4.0 |

NRW = WetAid NRW (BF Goodrich), wetting agent
NFR = Freerez NFR: proprietary DMDHEU resin (Noveon Inc., Cleveland, OH), durable press agent.
JVA = Phobotex JVA
NPE40 = Ultrasoft NPE-40 (MFG Chemical, Dalton, GA), softener
MG-2 = $MgCl_2$ resin catalyst
FSA = formamidine sulfinic acid

What is claimed is:

1. A durable press finish composition for a cellulosic fibrous substrate, which finish composition comprises formamidine sulfinic acid; a durable press agent; a catalyst; and at least one water- and oil-repellent agent.

2. A durable press finish composition for a cellulosic fibrous substrate which finish composition comprises formamidine sulfinic acid; a durable press agent; a catalyst; and a mixture of a polyethylene softener and at least one water- and oil-repellent agent.

3. An improved durable press finish composition comprising a durable press agent and a catalyst, the improvement comprising adding to the durable press formulation formamidine sulfinic acid and at least one water- and oil-repellent agent.

4. An improved durable press finish composition comprising a durable press agent and a catalyst, the improvement comprising adding to the durable press formulation formamidine sulfinic acid and a mixture of a polyethylene softener and at least one water- and oil-repellent agent.

* * * * *